United States Patent [19]

Bichon

[11] Patent Number: 4,669,352

[45] Date of Patent: Jun. 2, 1987

[54] TYING DEVICE FOR THE MOUTH PIECE OF A WIND INSTRUMENT

[76] Inventor: Serge Bichon, 3 Impasse des Glycines, F-69340 Francheville, France

[21] Appl. No.: 896,558

[22] Filed: Aug. 14, 1986

[30] Foreign Application Priority Data

Aug. 14, 1985 [FR] France ..... 85 12403

[51] Int. Cl.[4] ..... G10D 9/02
[52] U.S. Cl. ..... 84/383 R
[58] Field of Search ..... 84/383

[56] References Cited

U.S. PATENT DOCUMENTS

| | | | |
|---|---|---|---|
| 1,575,621 | 3/1926 | Chiron et al. | 84/383 B |
| 2,292,584 | 8/1942 | Tafarella | 84/383 B |
| 3,618,440 | 11/1971 | Ratterree | 84/383 B |
| 4,056,997 | 11/1977 | Rovner | 84/383 B |

*Primary Examiner*—Lawrence R. Franklin
*Attorney, Agent, or Firm*—William A. Drucker

[57] ABSTRACT

A tying device is provided for the mouth-piece of a wind instrument, formed by a strip of leather with a U shaped profile in which the upper end of the two legs cooperate with clamping screws. On the inner face of the bottom of the U is riveted a metal plate coated with a rubber layer grooved in the direction of the fibers of the reed with which it is intended to cooperate.

4 Claims, 2 Drawing Figures

TYING DEVICE FOR THE MOUTH PIECE OF A WIND INSTRUMENT

BACKGROUND OF THE INVENTION

The invention relates to tying devices for fixing the reed to the mouth-piece of a wind instrument.

Ties are known, used in the present time, which are formed by a flexible strip with a U profile, made from leather or from a synthetic material, whose bottom cooperates with the reed to be held in position whereas the two wings of this strip are applied to the mouth-piece of the instrument against which they are pressed adjustably by clamping screws.

The inventor has discovered that by making modifications to the known tying devices mentioned above, it is possible to obtain in a surprising way, a greater versatility of the sound produced by the instrument, a greater brightness of sound and the emission of sound is made easier (attack of notes, laying of the sound).

According to the invention, in order to obtain the advantageous results mentioned above the bottom of the U shaped profile forming a cradle of the known typing device, receives on the inside, on its part intended to cooperate with the reed, a coating of flexible material, (for example rubber), grooved in the direction of the fibers of the reed. A metal plate (for example made from aluminium) is interposed between the inner face of the bottom of the U profile and the grooved flexible material.

BRIEF DESCRIPTION OF THE DRAWINGS

In order to well understand the tying device of the invention, a preferred embodiment thereof will be described hereafter with reference to the schematical accompanying drawing in which.

DESCRIPTION OF THE PREFERRED EMBODIMENT

Figure 1:
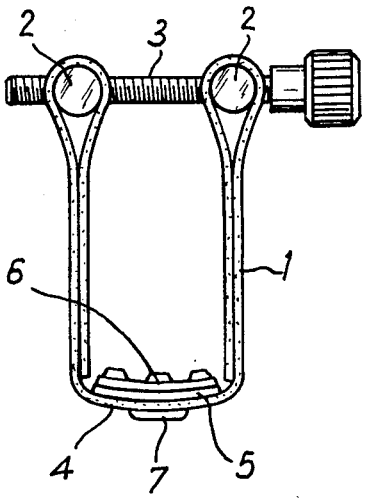
FIG. 1 is a front view of a tying device of the invention.
Figure 2:
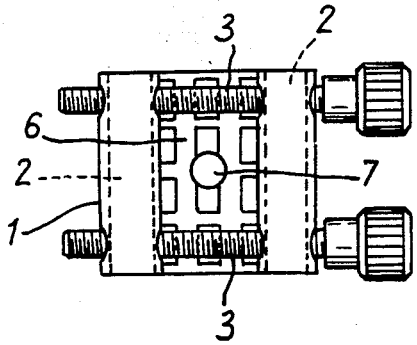
FIG. 2 is a top view of a tying device of FIG. 1.

The tying device shown in the drawings includes a strip of leather 1 with a U shaped profile in which the upper sleeve shaped end of each leg receives a cylindrical element 2. Two transverse parallel clamping screws 3 pass through tapped openings formed in the metal elements 2 for allowing the clamping force of the tie on the mouth-piece of the instrument (not shown) to the adjusted. The bottom 4 of the U formed by strip 1 receives on its inner face an aluminium plate 5 coated with a layer of rubber 6 intended to engage with the reed (not shown) and grooved in the direction of the fibers of the reed. A rivet 7 fixes on the inner face of bottom 4, the assembly formed by the metal plate 5 and the rubber lining 6.

It will be understood that the above description has been given solely by way of example, without any limitative character, and that additions or constructional modifications could be made thereto without departing from the scope and spirit of the invention defined by the accompanying claims.

What is claimed is:

1. A tying device for fixing a reed to the mouth-piece of a wind instrument, which comprises:

a flexible strip with a U-shaped profile, presenting a cradle shaped bottom of which the inner face cooperates with the reed to be held in position and two wings applied to the mouth-piece of the instrument against which they are pressed by clamping screws, a coating of flexible material on the inner face of the bottom of the flexible trip, said coating being grooved in the direction of the fibers of the reed, and a metal plate disposed between the bottom of the flexible strip and the flexible material coating.

2. The tying device as claimed in claim 1, wherein the flexible coating is made of rubber.

3. The tying device as claimed in claim 1, wherein the flexible coating is made from a synthetic material.

4. The device as claimed in claim 1, wherein said metal plate is made from aluminium.

* * * * *